US008136856B2

(12) United States Patent
Schwanbeck

(10) Patent No.: US 8,136,856 B2
(45) Date of Patent: Mar. 20, 2012

(54) LOAD SUSPENSION HOOK WITH LATTICEWORK

(75) Inventor: Steffen Schwanbeck, Gevelsberg (DE)

(73) Assignee: Spanset Inter AG, Wollerau (CH)

( * ) Notice: Subject to any disclaimer, the term of this patent is extended or adjusted under 35 U.S.C. 154(b) by 235 days.

(21) Appl. No.: 12/067,753

(22) PCT Filed: Sep. 22, 2006

(86) PCT No.: PCT/EP2006/066618

§ 371 (c)(1),
(2), (4) Date: Jun. 3, 2008

(87) PCT Pub. No.: WO2007/033986

PCT Pub. Date: Mar. 29, 2007

(65) Prior Publication Data

US 2008/0246292 A1 Oct. 9, 2008

(30) Foreign Application Priority Data

Sep. 22, 2005 (DE) ..... 20 2005 015 036 U

(51) Int. Cl.
*B66C 1/34* (2006.01)

(52) U.S. Cl. ..... 294/82.1

(58) Field of Classification Search ..... 294/1.1, 294/26, 82.1; 24/698.1; 59/90, 93
See application file for complete search history.

(56) References Cited

U.S. PATENT DOCUMENTS

| | | | | | |
|---|---|---|---|---|---|
| 677,086 | A | * | 6/1901 | Jones | 54/55 |
| 1,045,882 | A | * | 12/1912 | Price | 294/82.1 |
| 1,751,905 | A | * | 3/1930 | Button | 294/82.1 |
| 1,818,813 | A | | 8/1931 | Netz | |
| 2,592,389 | A | * | 4/1952 | Budy | 224/103 |
| 2,646,306 | A | * | 7/1953 | Foss | 294/82.1 |
| D189,487 | S | * | 12/1960 | Gale | D8/367 |
| 3,673,646 | A | | 7/1972 | Svensson | |
| 4,340,998 | A | * | 7/1982 | Liberge | 24/130 |
| 4,622,724 | A | * | 11/1986 | Dupre | 24/130 |
| D347,679 | S | * | 6/1994 | Yetter et al. | D22/149 |
| 5,339,555 | A | * | 8/1994 | Miskimins | 43/5 |
| 6,247,739 | B1 | * | 6/2001 | Lyon | 294/159 |
| 6,308,383 | B1 | * | 10/2001 | Schrader | 24/265 H |
| 6,647,674 | B1 | * | 11/2003 | Lancelot et al. | 52/125.4 |
| D521,362 | S | * | 5/2006 | Kelleghan | D8/356 |
| D532,074 | S | * | 11/2006 | Travis, Sr. | D22/149 |
| D536,415 | S | * | 2/2007 | Riley | D22/149 |

FOREIGN PATENT DOCUMENTS

| | | |
|---|---|---|
| DE | 31 19 859 | 12/1982 |
| FR | 1 048 183 | 12/1953 |

OTHER PUBLICATIONS

International Search Report for PCT/EP2006/066618.

* cited by examiner

*Primary Examiner* — Dean Kramer

(74) *Attorney, Agent, or Firm* — Proskauer Rose LLP

(57) ABSTRACT

A load acceptance hook for suspending a load provides for the movement of loads by simple means and despite a high load-bearing capacity has a reduced weight in relation to known hooks. This is achieved by the fact that it is formed at least in sections by a latticed framework, the braces of which are arranged and dimensioned depending on the stresses taking effect locally with the load suspended in the load acceptance hook.

18 Claims, 2 Drawing Sheets

LOAD SUSPENSION HOOK WITH LATTICEWORK

CROSS-REFERENCE TO RELATED APPLICATIONS

This application is a National Phase Application of International Application No. PCT/EP2006/066618, filed on Sep. 22, 2006, which claims the benefit of and priority to German patent application no. DE 20 2005 015 036.3, filed Sep. 22, 2005. The disclosure of each of the above applications is incorporated herein by reference in their entirety.

FIELD OF THE INVENTION

The invention relates to a load acceptance hook for suspending a load to be moved. A hook of this type is used as an intermediate element between the load to be moved and a lashing or lifting means, which is coupled to a transport device which initiates the individual movement of the load. So, for example, with cranes or comparable devices for pulling, raising, or lowering loads, the forces exerted by the crane take effect typically by means of chains, cables, or bands, which are connected by means of a hook to the load to be carried. The coupling of the load to the hook itself can in this context be effected in turn by means of suitable lashing and lifting means.

BACKGROUND

The function as an intermediate element between the drive device which exercises the force required for the movement and the load to be moved inevitably means that load acceptance hooks of the type in question must be capable of reliably transferring the static and dynamic forces which arise in the course of moving the load. Hooks which meet these requirements are usually manufactured by heat forming, in particular drop-forging, of a suitable steel. Such hooks are available, for example, under the designation JH-1 from Spanset AG, Oetwil am See, Switzerland, under the designation VIP-Cobra-Ösenhaken VCÖH, from RUD Kettenfabrik Rieger & Dietz GmbH & Co., Aalen, Germany or under the designation TWN 1835/1 6-XL from Thiele GmbH & Co. KG, Iserlohn, Germany. Forged hooks have a perceptibly higher load-bearing capacity than comparable components produced by casting or sintering.

In order to meet the constantly increasing loading requirements, despite the basically already high loading capacity of forged hooks, in the past materials have been developed which have been capable of sustaining ever increasing loads, the suitability of which for the manufacture of hooks of the kind in question has been increased still further thanks to suitable heat treatments.

At the same time, hooks have been developed the dimensions of which have been adapted to the demands which arise in practice. In particular due to the use of steel materials which are capable of high loading, subjected to additional suitable heat treatment, it has proved possible to avoid a disproportionate increase in weight as a result of the ever increasing dimensions of the hooks. It has nevertheless been shown that the hooks used in practice have in many cases become so heavy that they can only be handled with difficulty.

SUMMARY OF THE INVENTION

An aspect of the invention is to create by simple means a load acceptance hook for moving loads which, despite having a high load-bearing capacity, has a reduced weight in relation to the known hooks.

This aspect includes a load acceptance hook into which the load to be moved can be suspended, in which, according to the invention, at least in sections a latticed framework is formed, the braces of which are arranged and dimensioned depending on the stresses taking effect locally with the load suspended from the hook.

Due to the latticed framework-like arrangement of at least one section, with a hook according to the invention a clear weight reduction can be achieved in relation to known hooks, which are usually designed as solid bodies. In this context, a hook according to the invention has a load-bearing capacity which is at least equal to the load-bearing capacity of conventional hooks of the same dimensions. This property of hooks according to the invention is assured by the fact that, in the individual latticed framework sections, the braces of the latticed framework are in each case arranged and laid out in such a way that in practical use they can reliably accept the forces occurring in the particular zone of the hook. In the neutral zones of the latticed framework section, i.e. those which are non-load bearing, the hook material can, by contrast, be reduced to a minimum or even left out completely.

Inasmuch as the invention makes use of the principle of the latticed framework, such as has long been known in bridge or house building, a skeleton-like structure is created in the area of the hook provided with the latticed framework, in which the loads are accepted by the braces of the latticed framework, while the areas between the braces are formed either as openings or can be filled with filling material of lower weight or lesser strength.

One embodiment of the invention of particular advantage with regard to economical manufacture by forging is characterised in that the intermediate spaces between the braces are filled with filling material the thickness of which is less than the thickness of the ribs, wherein the filling material is connected as one piece to the braces.

According to the usual design of conventional hooks, a load acceptance hook according to the invention can have a carrying section for coupling a carrying means, such as a chain, cable, belt, or band, and a hook section connected to the carrying section for suspending the load which is to be moved. Carrying section and hook section can in this situation basically be coupled together by means of a rotating joint or another joint which allows relative movement between the carrying section and the hook section. The advantages of a design according to the invention of a load acceptance hook have a particularly favourable effect, however, if the carrying section and hook section are designed as one piece, since in this case the weight saving achieved with the latticed framework design can be optimised.

Depending on the individual basic design of the load acceptance hook and the requirements which arise in practice for handling and forming, it can be advantageous for the latticed framework to be formed in the area of the carrying section, while the hook section is formed solid. Such a design can, for example, be advantageous if wide contact surfaces or specific formed elements are to be formed in the area of the hook, which are necessary for coupling or securing the load to be moved. As an alternative, the latticed framework can also be formed in the area of the hook section, while the carrying section is formed as solid. This embodiment can be advantageous, for example, if an eye or a comparably large opening is to be formed for the carrying means to be coupled to the hook. The term "solid" formation of the individual sections of the hook is understood here to mean a design in which the sections affected do not have any clearly delineated differences in thickness from braces typified by a latticed framework but in which the more or less thick areas merge into one another in soft transition areas over a large surface area, as with conventional hooks.

A further particularly suitable embodiment of the invention for providing practical handling and at the same time guaranteeing high stability is characterised in that a load acceptance hook according to the invention has in the area of the latticed framework at least in sections an outer rib, by which the outer contour of the individual section is determined. This outer rib ensures that no undesired hooking of the carrying means or of the load to be moved by the braces of the latticed framework takes place and also prevents the users of such a hook from being injured by freely projecting edged objects.

A special advantage of the invention lies in the fact that it can be easily implemented as regards forging. Accordingly, a particularly advantageous embodiment of a load acceptance hook according to the invention lies in the fact that it is a forged component.

BRIEF DESCRIPTION OF THE DRAWING

The invention is described hereinafter in greater detail on the basis of drawings representing an embodiment. The figures show in a diagrammatic side view.

Figure 1:
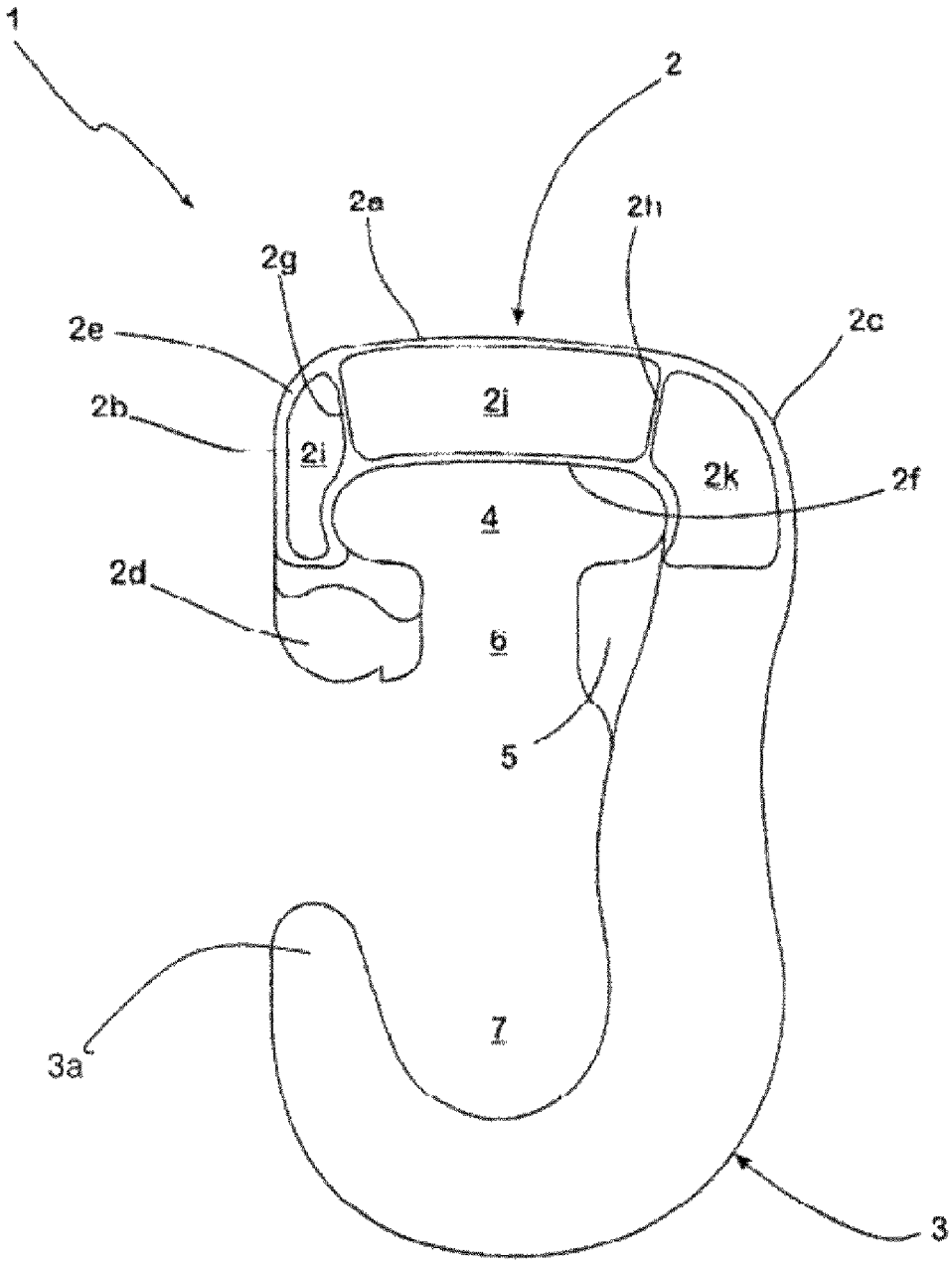
FIG. 1 A first load acceptance hook

The load acceptance hook 1 represented in FIG. 1, forged as one piece from a steel material, has a carrying section 2 and a hook section 3 connected to it.

The carrying section 2, designed as a latticed framework structure, delimits an acceptance area 4 with its central middle area 2*a*, its end section 2*b*, connected to the middle area 2*a* and pointing from one end of this freely in the direction of the hook section, and its transition section 2*c* connecting to the other end and merging into the hook section 3. Into the acceptance area 4, as a carrying means, a lifting belt, not shown here, can for example be placed, by means of which the hook 1 can, for example, be coupled to a crane, likewise not shown.

The free end of the end section 2*b* is cropped off with its end section 2*d* in the direction of the transition section 2*c*. In a corresponding manner, at the transition section 2*c* a projection 5 is formed, aligned in the direction of the end section 2*b*. In this way, the projection 5 and the free end of the end section 2*b* delimit between them a passage 6 to the acceptance area 4, the width of which is less than the width of the acceptance area 4. The material thickness of the projection 5 and of the end section 2*b* in its cropped holohedrally formed end area 2*d* is here substantially thinner than the material thickness in the adjacent areas of the hook 1.

The cropped end area 2*d* of the end section 2*b* transfers on its outer circumferential side over a transition zone of solid design and of low height into an outer rib 2*e*, which runs over the entire circumference of the carrying section 2 as far as the end of the transition section 2*c*, and opens there into the material of the hook section 3. In a corresponding way, an inner rib 2*f* goes from the cropped end area 2*d* of the end section 2*b*, which is guided around the acceptance area 4 over the transition section 2*c* as far as the material of the hook section 3.

In addition, extending from the two upper corner areas of the acceptance area 4, allocated to the middle area 2*a* of the carrying section 2, between the inner rib 2*f* and the outer rib 2*e*, is in each case a brace 2*g*, 2*h*, by which the outer rib 2*e* and the inner rib 2*f* are mutually supported. The braces 2*g*, 2*h* divide the opening of the carrying section 2, delimited by the outer rib 2*e* and the inner rib 2*f*, into three opening sections 2*i*, 2*j*, 2*k* which are free of the steel material of the hook 1. The outer rib 2*e*, the inner rib 2*f*, and the webs 2*g*, 2*h* in this way form a latticed framework, by means of which the carrying section 2, despite its perceptibly lower weight in relation to a solid design, attains a stability and load-carrying capacity which come close to carrying sections in conventional solid designs.

Connected to the latticed framework-like carrying section 2 of the hook 1 is the hook section 3, made of solid material without apertures formed in it. The free end area 3*a* of this is designed curved in such a way that it engages around a load acceptance area 7, positioned opposite the acceptance area 4 intended for the carrying means, in which the load to be moved, not represented here, can be suspended.

Figure 2:
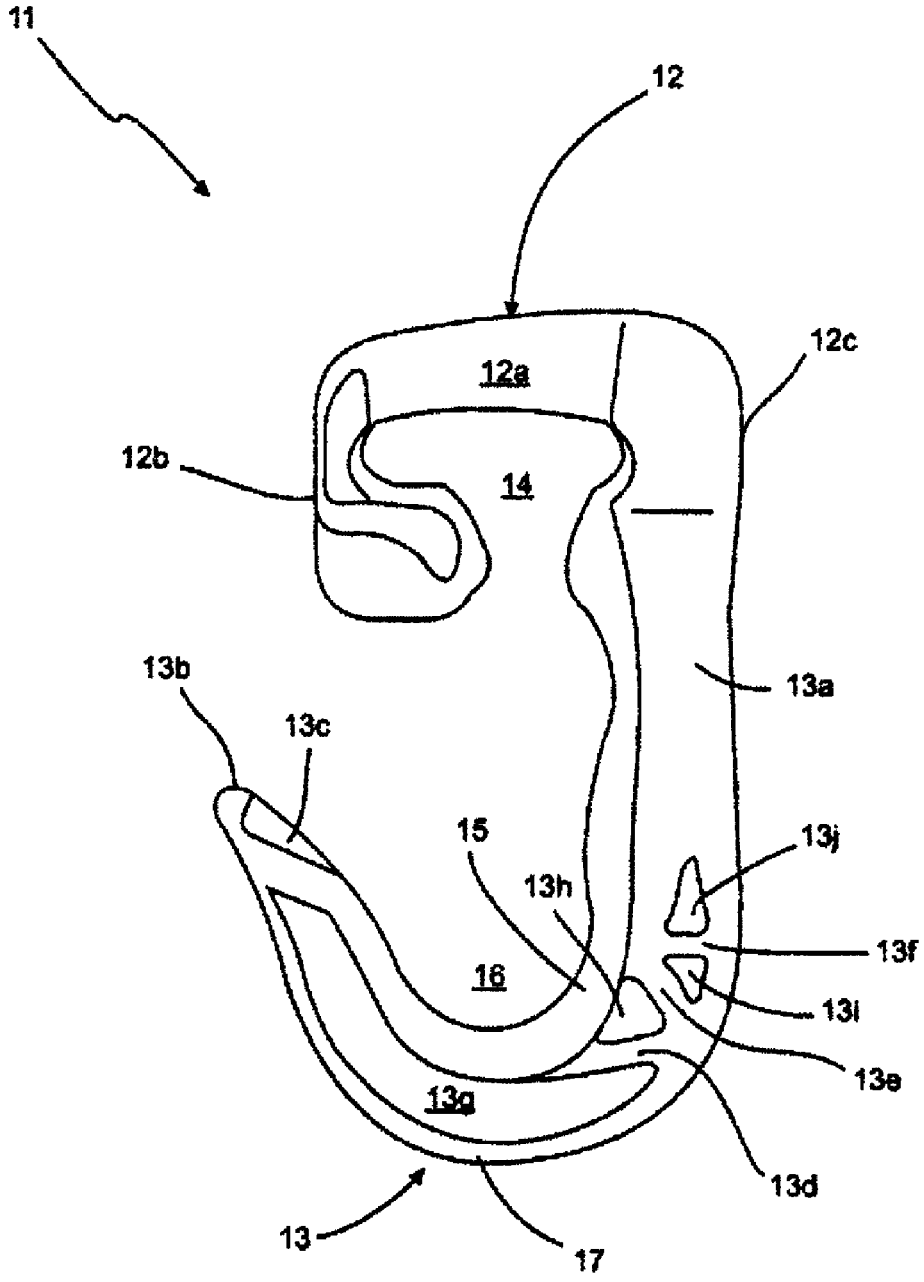
FIG. 2 A second load acceptance hook

The load acceptance hook 11 represented in FIG. 2, designed as a single forged piece, likewise has a carrying section 12 and a hook section 13 connecting to the carrying section 12. Unlike the hook 1, however, with the hook 1 the carrying section 12 is formed from solid metal, i.e. not as a latticed framework structure, while the hook section 11 is formed by a latticed framework.

As with the hook 1, with the hook 11 the carrying section 12 engages with its central middle section 12*a*, its cropped free end section 12*b* and its transition section 12*c* an acceptance area 14, into which a band or belt-like carrying means, not represented here, can be placed in order to couple the hook 11 to a crane, likewise not shown.

The transition section 12*c* merges into a connection section 13*a* of the hook section 13, to the inner side of which, allocated to the acceptance area 14, an inner rib 15 is embedded. The rib 15 is guided out from the connection section 13*a* in a curve in the direction of the free end section 12*a* of the carrying section 12 and in this way encompasses the load acceptance area 16 of the load acceptance hook 11. The inner rib 15 ends at the free tip 13*b* of the hook section 13, aligned in the direction of the end section 12*a* but arranged at a distance from this, and there merges into an outer rib 17, which is guided around the outer circumference of the hook section 13 in a larger curve back to the connection section 13*a*. At the transition from the inner rib 15 to the outer rib 17, in this situation a web 13*c* is formed on the side of the tip 13*b* of the hook section 13, allocated to the load acceptance area 16, aligned along the length of the rib 15, serving to brace the tip 13*b*.

In the area of the transition to the connection section 13*a* of the hook section 13, braces 13*d*, 13*e*, 13*f* extend between the inner rib 15 and the outer rib 17, by means of which the outer rib 17 is supported against the inner rib 15 in the area in which the highest loadings occur when a load is suspended in the hook 11. The braces 13*d*, 13*e*, 13*f* divide the opening delimited by the inner rib 15, the outer rib 17 and the connection section 13*a* into opening sections 13*g*, 13*h*, 13*i*, 13*j*, which can be freely passed through.

Due to the latticed framework-like formation of its hook section 13, the load acceptance hook 11 also has a perceptibly lower weight than a completely solidly formed hook of the same outer appearance, while at the same time having identical mechanical properties.

It is of course possible, in order to save further weight, with the hook 1 for the hook section 3 to be designed as a latticed framework design, in accordance with the example of the hook section 13 of the hook 11. Likewise, with the hook 11 its carrying section 12 can be designed in the way that the carrying section 2 of the hook 1 is designed, as a latticed framework, in order to save further material for the load acceptance hook 11.

Reference Numbers

1 Load acceptance hook
2 Carrying section of the load acceptance hook 1
2*a* Middle area of the carrying section 2
2*b* End section of the carrying section 2
2*c* Transition section of the carrying section 2
2*d* End area of the carrying section 2
2*e* Outer rib
2*f* Inner rib
2*g*, 2*h* Braces
2*i*, 2*j*, 2*k* Opening sections
3 Hook section of the load acceptance hook 1
4 Acceptance area
5 Projection
6 Passage to acceptance area 4
7 Load acceptance area
11 Load acceptance hook 11
12 Carrying section of the load acceptance hook 11
12*a* Middle section of the carrying section 12
12*b* End section of the carrying section 12
12*c* Transition section of the carrying section 12
13 Hook section of the load acceptance hook 11
13*a* Connection section of the hook section 13
13*b* Tip of the hook section 13
13*c* Web
13*d*, 13*e*, 13*f* Braces
13*g*, 13*h*, 13*i*, 13*j* Opening sections
14 Acceptance area
15 Inner rib
16 Load acceptance area
17 Outer rib

The invention claimed is:

1. A load acceptance hook for suspending a load to be moved, the hook comprising:

a carrying section for coupling a carrying means; and a curved hook section connected to the carrying section for suspending the load which is to be moved;

wherein the curved hook section includes a lattice framework including braces which are arranged and dimensioned as a function of stresses taking effect locally due to the load suspended from the hook, wherein the carrying section defines an acceptance area, the carrying section comprises:

an end section; and a projection formed at a transition section which merges into the curved hook section, wherein the end section points in a direction towards the projection and the projection points in a direction towards the end section such that a passage between the end section and the projection is formed, a width of the passage is less than a width of the acceptance area.

2. The hook of claim 1, wherein intermediate spaces between the braces are filled with filling material, the thickness of which is less than the thickness of the braces.

3. The hook of claim 2, wherein the filling material is connected as one piece to the braces.

4. The hook of claim 1, wherein the lattice framework has at least one external rib which defines an outer contour of the hook section or the carrying section.

5. The hook of claim 1, wherein the hook is a forged component.

6. The hook of claim 5, wherein the hook is formed as a single piece.

7. A load acceptance hook for suspending a load to be moved, the hook comprising:

a carrying section for coupling a carrying means, the carrying section defining an acceptance area and comprising an end section that is cropped off and a projection formed at a transition section, wherein the end section points in a direction towards the projection and the projection points in a direction towards the end section such that a passage between the end section and the projection is formed, a width of the passage is less than a width of the acceptance area; and a solid curved hook section connected to the carrying section at the transition section for suspending the load which is to be moved;

wherein the carrying section includes a lattice framework including braces which are arranged and dimensioned as a function of stresses taking effect locally due to the load suspended from the hook.

8. The hook of claim 7, wherein intermediate spaces between the braces are filled with filling material, the thickness of which is less than the thickness of the braces.

9. The hook of claim 8, wherein the filling material is connected as one piece to the braces.

10. The hook of claim 7, wherein the lattice framework has at least one external rib which defines an outer contour of the hook section or the carrying section.

11. The hook of claim 7, wherein the hook is a forged component.

12. The hook of claim 11, wherein the hook is formed as a single piece.

13. A load acceptance hook for suspending a load to be moved, the hook comprising:

a carrying section for coupling a carrying means, the carrying section defining an acceptance area and comprising an end section and a projection formed at a transition section, wherein the end section points in a direction towards the projection and the projection points in a direction towards the end section such that a passage between the end section and the projection is formed, a width of the passage is less than a width of the acceptance area; and a hook section connected to the carrying section at the transition section for suspending the load which is to be moved;

wherein the hook section includes a lattice framework including braces which are arranged and dimensioned as a function of stresses taking effect locally due to the load suspended from the hook.

14. The hook of claim 13, wherein intermediate spaces between the braces are filled with filling material, the thickness of which is less than the thickness of the braces.

15. The hook of claim 14, wherein the filling material is connected as one piece to the braces.

16. The hook of claim 13, wherein the lattice framework has at least one external rib which defines an outer contour of the hook section or the carrying section.

17. The hook of claim 13, wherein the hook is a forged component.

18. The hook of claim 17, wherein the hook is formed as a single piece.

* * * * *

UNITED STATES PATENT AND TRADEMARK OFFICE

CERTIFICATE OF CORRECTION

PATENT NO. : 8,136,856 B2
APPLICATION NO. : 12/067753
DATED : March 20, 2012
INVENTOR(S) : Schwanbeck It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 251 days.

Signed and Sealed this
Twenty-fourth Day of July, 2012

David J. Kappos

David J. Kappos
*Director of the United States Patent and Trademark Office*